US005469690A

United States Patent [19]

Nordell

[11] Patent Number: 5,469,690

[45] Date of Patent: Nov. 28, 1995

[54] CAM MECHANISM FOR BENDING CARTON BLANKS FED FROM THE MAGAZINE OF A PACKAGING MACHINE

[76] Inventor: Joakim Nordell, 1512 Seville Ct. 2A, Wheeling, Ill. 60090

[21] Appl. No.: 315,406

[22] Filed: Sep. 28, 1994

[51] Int. Cl.[6] ..... B65B 43/24; B65B 43/44

[52] U.S. Cl. ..... 53/458; 53/564; 53/566; 493/395; 493/454

[58] Field of Search ..... 53/564, 566, 565, 53/458; 493/395, 454

[56] References Cited

U.S. PATENT DOCUMENTS

| | | | |
|---|---|---|---|
| 639,354 | 12/1899 | Butler | 53/566 X |
| 1,001,268 | 8/1911 | Heybach . | |
| 2,357,535 | 9/1944 | Monroe . | |
| 2,831,407 | 4/1958 | Pittman et al. . | |
| 2,973,611 | 3/1961 | Engelson et al. | 53/566 X |
| 3,002,328 | 10/1961 | Monroe et al. . | |
| 3,129,542 | 4/1964 | Fahrenbach | 53/566 X |
| 3,207,049 | 9/1965 | Monroe et al. . | |
| 3,302,365 | 2/1967 | Currie | 53/566 X |
| 3,566,762 | 3/1971 | Vadas et al. . | |
| 3,690,223 | 9/1972 | Klausmann et al. . | |
| 3,740,919 | 6/1973 | Heisler | 53/566 X |
| 5,007,889 | 4/1991 | Wakabayashi et al. . | |
| 5,127,894 | 7/1992 | Maccaferri | 53/566 X |
| 5,415,615 | 5/1995 | Culpepper | 53/566 X |

FOREIGN PATENT DOCUMENTS

0425226A1 5/1991 European Pat. Off. .

*Primary Examiner*—Horace M. Culver
*Attorney, Agent, or Firm*—McAndrews, Neld & Malloy Ltd.

[57] ABSTRACT

An improved cam mechanism bends carton blanks fed from the magazine of a packaging machine. The carton blanks each have a gripped portion attached to the packaging machine and a bendable portion extending from the gripped portion. The cam mechanism includes a rotatable shaft mounted on the packaging machine and at least one cam member mounted on the shaft. The cam member has a plurality of longitudinally extending side walls and apex portions interconnecting the side walls. Rotating the shaft about its longitudinal axis positions the side walls adjacent the gripped portions of the carton blank, and the apex portions radially displace the bendable portions of the carton blanks as the carton blanks are fed from the magazine.

5 Claims, 7 Drawing Sheets

FIG. 4A
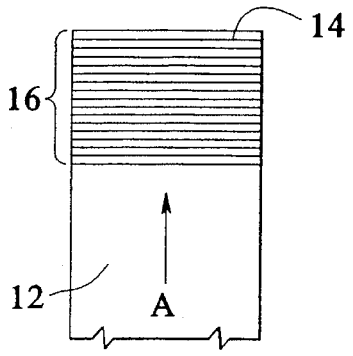
FIG. 4B
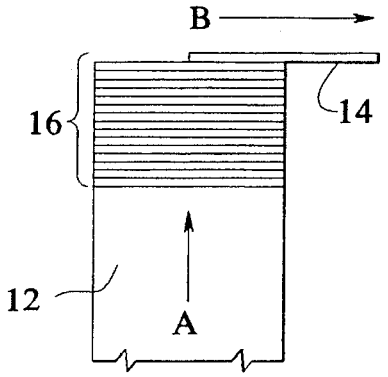
FIG. 4C
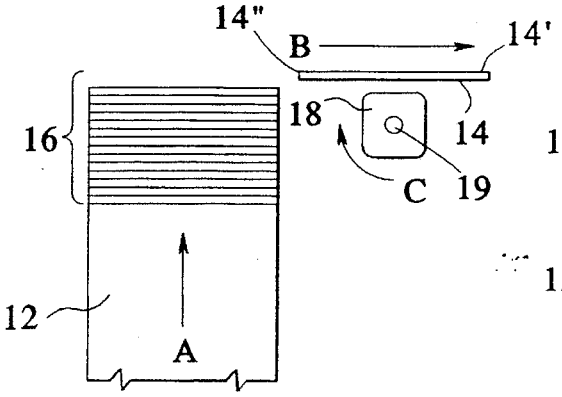
FIG. 4D
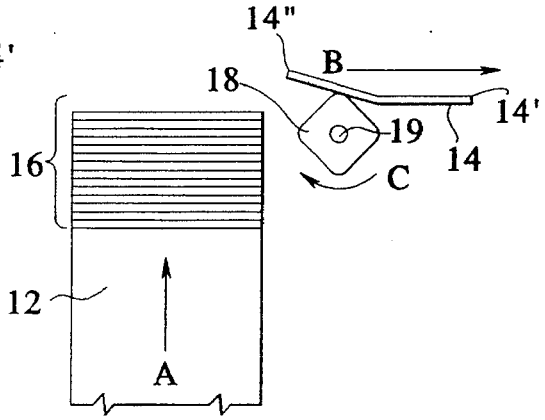
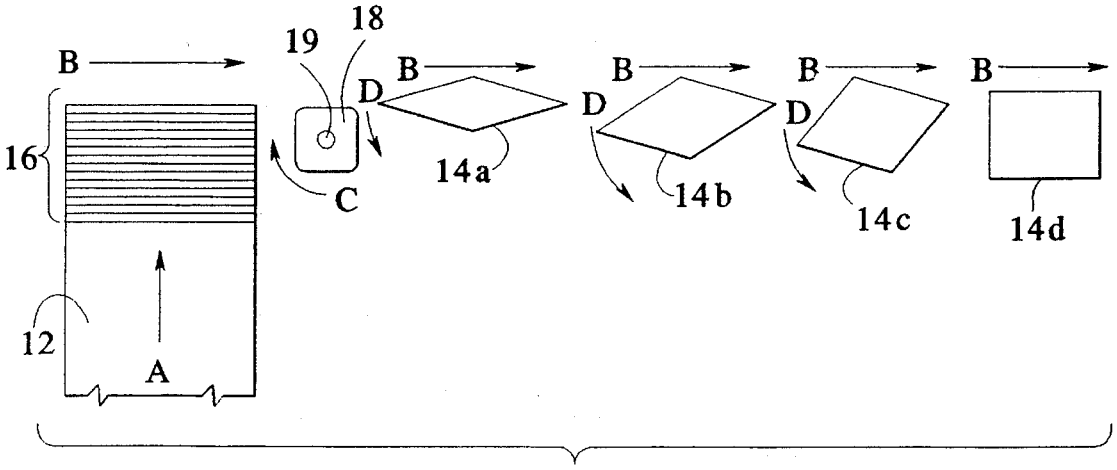
FIG. 4E

CAM MECHANISM FOR BENDING CARTON BLANKS FED FROM THE MAGAZINE OF A PACKAGING MACHINE

TECHNICAL FIELD

The present invention relates to packaging machines. In particular, the present invention relates to a cam mechanism for bending carton blanks introduced from the magazine of a packaging machine.

BACKGROUND OF THE INVENTION

In packaging machines that produce sealed cartons containing food products or liquids, the carton blanks are typically introduced to the machine from a magazine. The magazine usually holds a stack of carton blanks in a unerected and compressed state, and urges the carton blanks toward the gate portion of the magazine. The gate positions and holds the carton blanks so they can be picked one at a time by a mechanism that unfolds and erects the blanks to form cartons having side walls and unsealed top and bottom panels. After the bottom panel of the erected carton blank is sealed, a food product or a liquid can be received in the carton, the top panel of the carton can then be formed and sealed, and the filled and sealed carton can be dispensed from the packaging machine for eventual shipment to the consumer.

As the carton blanks are unfolded and erected by the mechanism that receives the individual carton blanks from the gate, the blanks can either be erected properly in a rectangularly-shaped manner or improperly in an L-shaped manner. A properly erected, rectangularly-shaped carton blank has substantially perpendicular adjacent side walls, and is capable of having its bottom panels properly folded and sealed so that the carton interior can be filled and the top panels properly folded and sealed. In an improperly erected, L-shaped carton blank, pairs of adjacent side walls are parallel (that is, the carton blank folds in on itself). Thus, the bottom panels in an improperly erected, L-shaped carton blank are not aligned for proper sealing, and the carton cannot therefore be filled and sealed reliably.

SUMMARY OF THE INVENTION

An improved apparatus bends carton blanks fed from the magazine of a packaging machine. Each of the carton blanks has a gripped portion held by the packaging machine and a bendable portion extending from the gripped portion. The improved apparatus includes a rotatable shaft mounted on the packaging machine. The shaft has a longitudinal axis. At least one cam member is mounted on the shaft. The at least one cam member has a plurality of longitudinally extending side walls and apex portions interconnecting the side walls. The apparatus also includes a mechanism for rotating the shaft about its longitudinal axis such that the side walls are adjacent the gripped portions of the carton blanks and the apex portions radially displace the bendable portions of the carton blanks as the carton blanks are fed from the magazine.

In the preferred apparatus, the at least one cam member includes a plurality of longitudinally spaced cam members. The preferred cam member has four longitudinally extending side walls and four apex portions interconnecting the side walls. The shaft is preferably rotatably mounted on the magazine.

An improved method bends carton blanks fed from the magazine of a packaging machine. Each of the carton blanks has a gripped portion held by the packaging machine and a bendable portion extending from the gripped portion. The improved method includes the steps of (a) mounting a rotatable shaft on the packaging machine, the shaft having a longitudinal axis, (b) mounting at least one cam member on the shaft, the at least one cam member having a plurality of longitudinally extending side walls and apex portions interconnecting the side walls, and (c) rotating the shaft about its longitudinal axis such that the side walls are adjacent the gripped portions of the carton blanks and the apex portions radially displace the bendable portions of the carton blanks as the carton blanks are fed from the magazine.

BRIEF DESCRIPTION OF THE DRAWINGS

FIG. 4 is a schematic diagram illustrating the manner in which a carton blank is fed from the carton blank magazine, bent by the cam mechanism, and then properly erected to form a rectangularly-shaped carton.

DETAILED DESCRIPTION OF THE PREFERRED EMBODIMENTS

Figure 3:
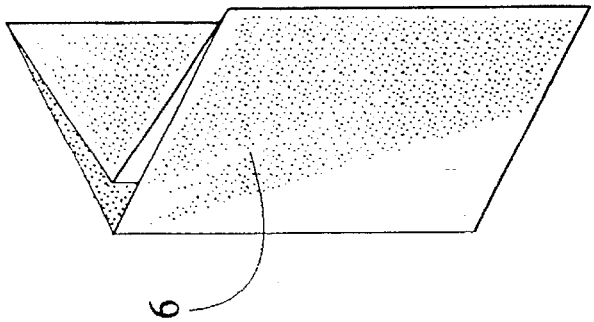
FIG. 3 is a perspective view of the carton blank illustrated in FIG. 1 in its improperly erected, L-shaped state.
Figure 2:
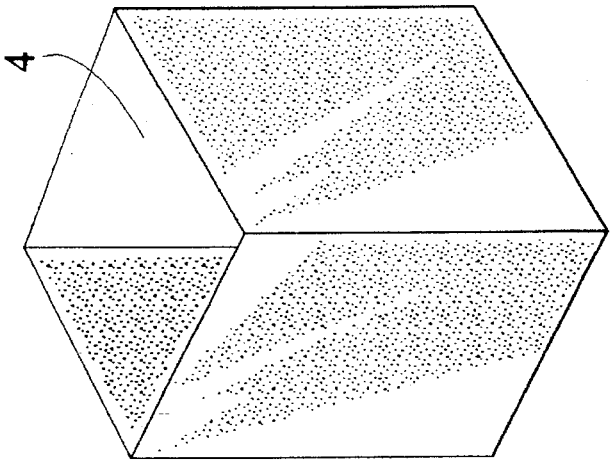
FIG. 2 is a perspective view of the carton blank illustrated in FIG. 1 in its properly erected, rectangularly-shaped state.
Figure 1:
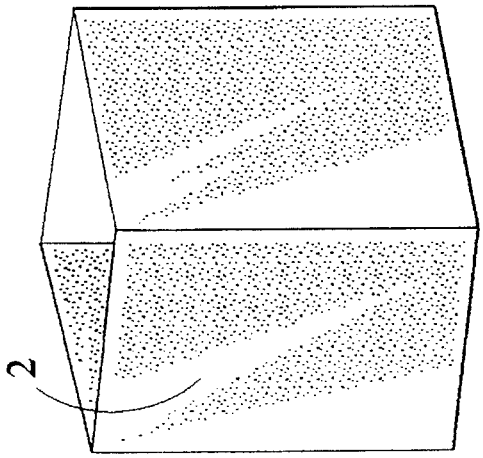
FIG. 1 is a perspective view of a carton blank, showing its side walls and with its top and bottom panels removed, in its unerected state.

Turning first to FIG. 1, a carton blank 2 is shown in its unerected state with its top and bottom panels removed. FIG. 2 shows a carton blank 4 in its properly erected, rectangularly-shaped state. FIG. 3 shows a carton blank 6 in its improperly erected, L-shaped state.

FIG. 4 is a schematic diagram illustrating the manner in which a carton blank 14 is fed from a carton blank magazine 12 of a packaging machine, bent by a cam mechanism 18, and then properly erected to form a rectangularly-shaped carton 14*d*. In step (a) of FIG. 4, a carton blank 14 and succeeding carton blanks 16 are contained within magazine 12 and are urged by a pusher mechanism (not shown) and compressed in the direction of arrow A. In step (b), carton blank 14 is fed from magazine 12 in the direction of arrow B, while the succeeding carton blanks 16 remain compressed in the direction of arrow A within magazine 12. In step (c), carton blank 14 is further displaced in the direction of arrow B from the magazine by the attachment of a gripped portion 14' of the carton blank 14 to a moveable component (not shown) of the packaging machine. A bendable portion 14" extends from the gripped portion 14' of carton blank 14.

As further shown in step (c) of FIG. 4, a cam member 18 mounted on a shaft 19 is rotated in the direction of arrow C such that one of the side walls of cam member 18 is adjacent the gripped portion 14' as carton blank 14 is fed from the magazine. Step (d) of FIG. 4 shows one of the apex portions of cam member 18 radially displacing the bendable portion 14" as carton blank 14 is further displaced from the magazine 12 in the direction of arrow B. As a result of the bending of carton blank 14 in step (d), the carton blank assumes the conformation shown in step (e) as carton blank 14*a*. As the carton blank continues its displacement away from magazine 12 in the direction of arrow B, the lower apex of the carton blank rotates in the direction of arrow D so that the carton blank assumes the sequence of conformations shown in step (e) of FIG. 4 as carton blanks 14*b*, 14*c*, 14*d*. Carton blank 14*d* represents a properly erected, rectangularly-shaped carton blank, which is more readily assumed by virtue of the pre-breaking by the cam member 18.

Figure 5:
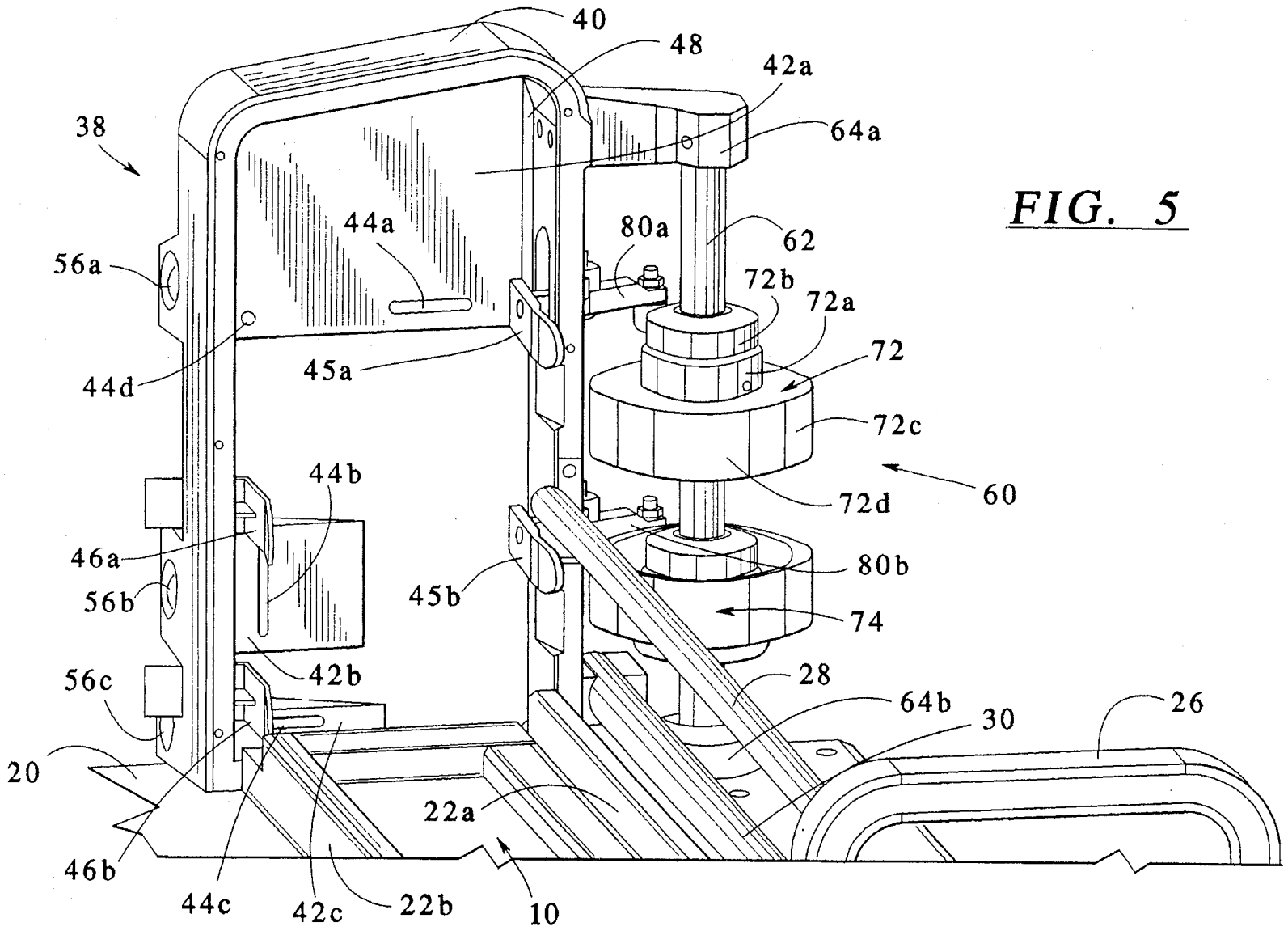
FIG. 5 is a perspective view of the gate assembly of a carton blank magazine and the adjacent bending cam mechanism.

FIG. 5 is a perspective view of the gate assembly 38 of a carton blank magazine 10 and the adjacent bending cam mechanism 60. The carton blank magazine 10 includes a magazine surface 20. Magazine surface 20 has a pair of oppositely facing, generally L-shaped rails 22*a*, 22*b* for receiving and containing a stack of carton blanks above magazine surface 20 and between rails 22*a*, 22*b*. The magazine 10 further includes a pusher 26 and a gate assembly 38. Pusher 26 is supported above magazine surface 20 by tubular support element 30. Tubular element 28 maintains the alignment of the carton blanks between pusher 26 and gate assembly 38. Pusher 26 is pneumatically biased so as to urge a stack of carton blanks loaded between rails 22*a*, 22*b* toward gate assembly 38. Pusher 26 also maintains the stack of carton blanks in an unerected and compressed state prior to their being presented to gate assembly 38.

As shown in detail in FIG. 5, gate assembly 38 includes a frame 40 fixedly mounted on magazine surface 20. Frame 40 has a longitudinal opening 48 formed therein for permitting the passage of a single carton blank (not shown in FIG. 5) therethrough. Frame 40 has air ducts 56*a*, 56*b*, 56*c* extending therethrough. Receiving members 42*a*, 42*b*, 42*c* extend from air ducts 56*a*, 56*b*, 56*c*, respectively.

Each of receiving members 42*a*, 42*b*, 42*c* has at least one slot formed in the surface thereof facing the magazine 10. As shown in FIG. 5, receiving member 42*a* has slots 44*a*, 44*d* formed therein. Receiving member 42*b* has a slot 44*b* formed therein. Receiving member 42*c* has a slot 44*c* formed therein. Each of receiving members 42*a*, 42*b*, 42*c* has at least one channel formed in its interior (not shown in FIG. 5) for communicating air between the slot(s) and the respective air duct. In this regard, a channel formed in the interior of receiving member 42*a* communicates air between slots 44*a*, 44*d* and air duct 56*a*. An interior channel in receiving member 42*b* communicates air between slot 44*b* and air duct 56*b*. An interior channel in receiving member 42*c* communicates air between slot 44*c* and air duct 56*c*.

FIG. 5 shows stationary guide fingers 46*a*, 46*b*, which direct the carton blanks into their proper position with respect to gate assembly 38 as the carton blanks are urged toward gate assembly 38 by pusher 26. Negative air pressure applied to air ducts 56*a*, 56*b*, 56*c* induces a carton blank from the magazine 10 into contact with receiving members 42*a*, 42*b*, 42*c*. The negative air pressure is preferably supplied by a fan (not shown in FIG. 5).

When a carton blank is in contact with receiving members 42*a*, 42*b*, 42*c*, a vacuum element of the rotary picker (shown for example in FIG. 3 as vacuum element 282) located behind gate assembly 38 laterally displaces the carton blank from gate assembly 38 through longitudinal opening 48. At the same time, moveable guide fingers 45*a*, 45*b* are urged forward (toward pusher 26) by cammed drive members 80*a*, 80*b* from their normally rearward positions to uncover opening 48 sufficiently to permit passage of a single carton blank through opening 48. The downwardly extending wheel of each of the cammed drive members 80*a*, 80*b* are urged to rotate by the frictional contact of the wheel against drive collar 72*b* secured to rotating shaft 62. Moveable guide fingers 45*a*, 45*b* are urged forward as each carton blank is displaced from gate assembly 38.

As shown in FIG. 5, cam mechanism 60 includes substantially identical first and second cam members 72, 74 mounted on a rotatable shaft 62. Shaft 62 is rotatably mounted between bushings 64*a*, 64*b*. Upper bushing 64*a* is fixedly mounted on and extends laterally from frame 40 of gate assembly 38. Lower bushing 64*b* is fixedly mounted on magazine surface 20.

Cam member 72 in FIG. 5 comprises an annular fastening collar 72*a* for retaining cam member 72 on shaft 62, and an adjacent annular drive collar 72*b* which imparts rotational force to cammed drive member 80*a*. Cam member 72 also comprises longitudinally extending side walls, one of which is designated in FIG. 5 as side wall 72*c*, and apex portions interconnecting the side walls, one of which is designated in FIG. 5 as apex portion 72*d*. Cam member 74 is substantially identical in configuration to cam member 72, and imparts rotational force to cammed drive member 80*b*.

FIG. 5 also shows the respective locations of rails 22*a*, 22*b*, as well as pusher 26 and tubular support elements 28, 30, with respect to gate assembly 38.

Figure 6:
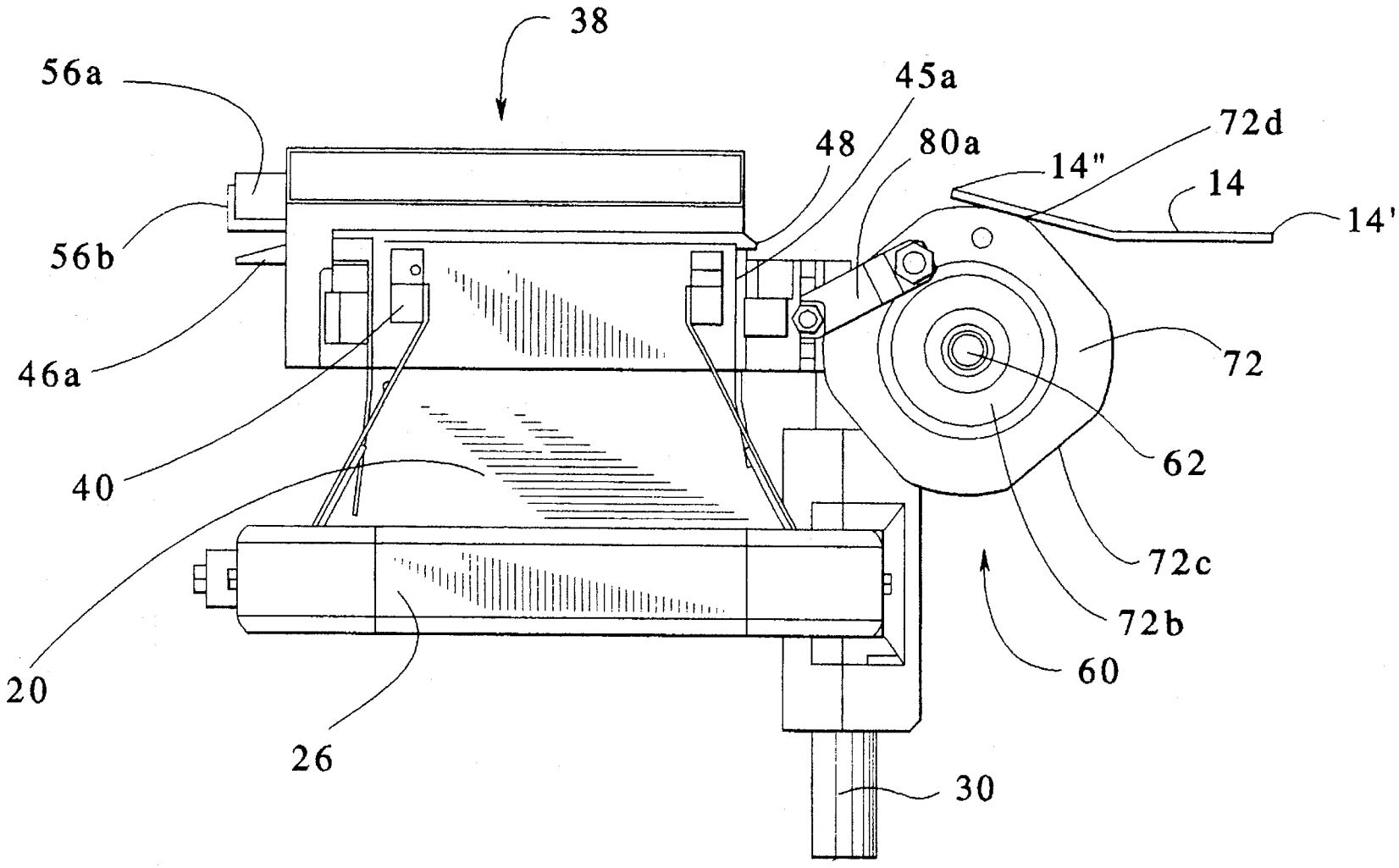
FIG. 6 is a top plan view, partially in section, of the gate assembly and bending cam mechanism illustrated in FIG. 5.

FIG. 6 is a top view of gate assembly 38 and bending cam mechanism 60, described in detail above with respect to FIG. 5, and further shown in relation to a carton blank 14. As shown in FIG. 6, rotation of shaft 62 about its longitudinal axis urges apex portion 72*c* of cam member 72 into contact with bendable portion 14" of carton blank 14. Blank 14 is displaced to the right in FIG. 6. and away from the magazine 10 by the attachment of gripped portion 14' of carton blank 14 to a moveable component (not shown) of the packaging machine.

Figure 7:
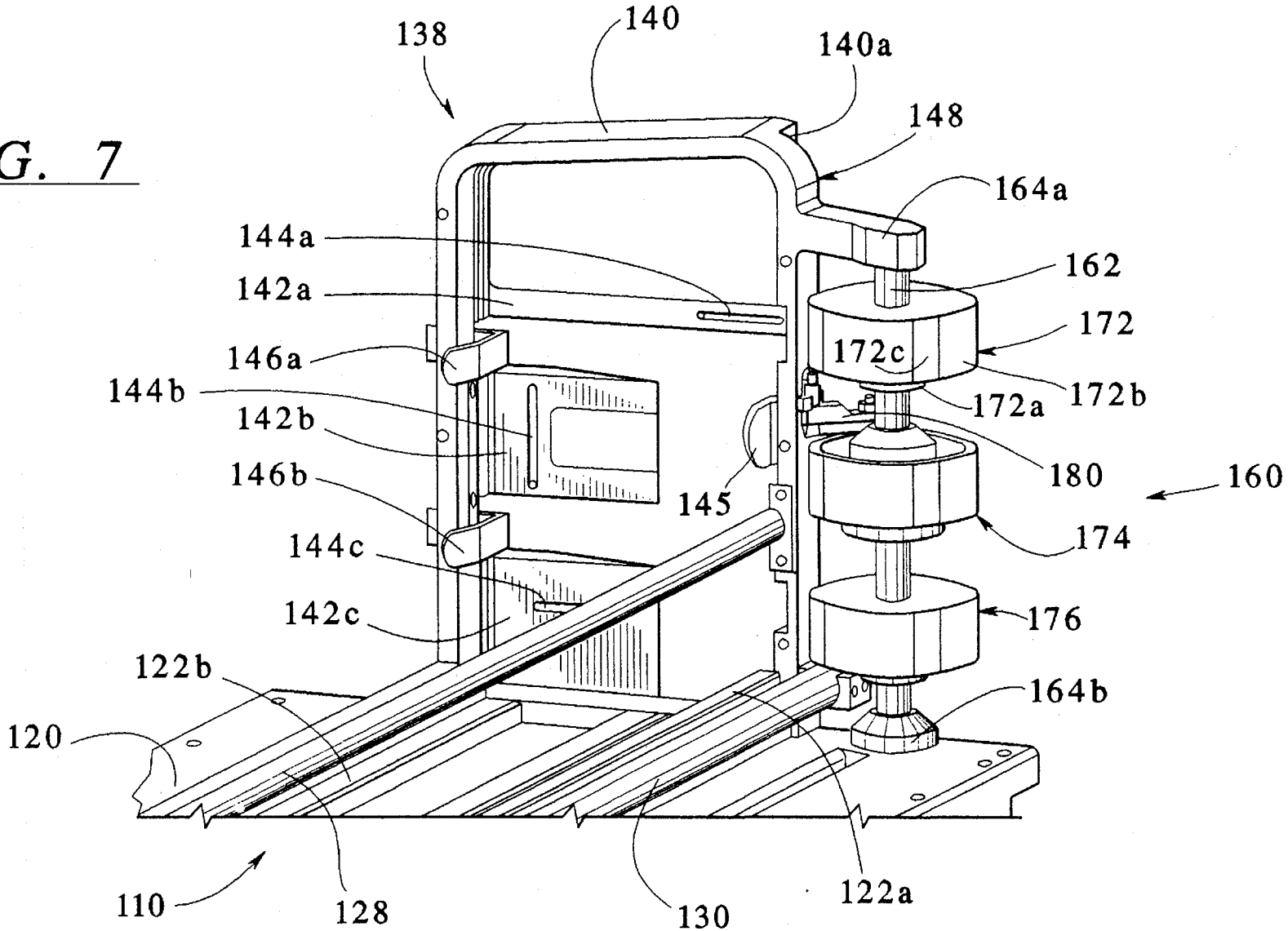
FIG. 7 is a perspective view of another embodiment of the gate assembly of a carton blank magazine and the adjacent bending cam mechanism.

FIG. 7 shows another embodiment of a gate assembly 138 of a carton blank magazine 110 and the adjacent bending cam mechanism 160. Gate assembly 138 and bending cam mechanism 160 are intended for use in conjunction with a smaller capacity carton (not shown in FIG. 7) than that for gate assembly 38 of FIGS. 5 and 6. The carton blank magazine 110 in FIG. 7 includes a magazine surface 120. Magazine surface 120 has a pair of oppositely facing, generally L-shaped rails 122*a*, 122*b* for receiving and containing a stack of carton blanks above magazine surface 120 and between rails 122*a*, 122*b*.

As shown in detail in FIG. 7, gate assembly 138 includes a frame 140 which is fixedly mounted at the end of a carton blank magazine 110 of the type shown in FIGS. 5 and 6. Frame 140 has a cut-out portion 140*a* which forms a longitudinal opening 148 for permitting the passage of a single carton blank therethrough. Each of receiving members 142*a*, 142*b*, 142*c* has at least one slot formed in the surface thereof facing the magazine 110. As shown in FIG.

7, receiving member 142*a* has slot 144*a* formed therein. Receiving member 142*b* has a slot 144*b* formed therein. Receiving member 142*c* has a slot 144*c* formed therein. Each of receiving members 142*a*, 142*b*, 142*c* has at least one channel formed in its interior (not shown in FIG. 7) for communicating air between the slot(s) and the respective air duct.

FIG. 7 shows stationary guide fingers 146*a*, 146*b*, which direct the carton blanks into their proper position with respect to gate assembly 138 as the carton blanks are urged toward gate assembly 138 by pusher 126. Negative air pressure applied to air ducts 156*a*, 156*b*, 156*c* induces a carton blank from the adjacent magazine 110 into contact with receiving members 142*a*, 142*b*, 142*c*. The negative air pressure may, for example, be supplied by a fan (not shown in FIG. 7).

When a carton blank is in contact with receiving members 142*a*, 142*b*, 142*c*, a vacuum element of the rotary picker (shown for example in FIG. 8 as vacuum element 282) located behind gate assembly 138 laterally displaces the carton blank from gate assembly 138 through longitudinal opening 148. At the same time, moveable guide finger 145 is urged forward (toward pusher 126) by cammed drive member 180 from its normally rearward position to uncover opening 148 sufficiently to permit passage of a single carton blank through opening 148. The downwardly extending wheel of cammed drive member 180 is urged to rotate by the frictional contact of the wheel against a drive collar secured to rotating shaft 162. Moveable guide finger 145 is urged forward as each carton blank is displaced from gate assembly 138.

As shown in FIG. 7, cam mechanism 160 includes substantially identical first, second and third cam members 172, 174, 176, respectively, mounted on a rotatable shaft 162. Shaft 162 is rotatably mounted between bushings 164*a*, 164*b*. Upper bushing 164*a* is fixedly mounted on and extends laterally from frame 140 of gate assembly 138. Lower bushing 164*b* is fixedly mounted on magazine surface 20.

Cam member 172 in FIG. 7 comprises an annular fastening collar 172*a* for retaining cam member 172 on shaft 162. Cam member 172 also comprises longitudinally extending side walls, one of which is designated in FIG. 7 as side wall 172*c*, and apex portions interconnecting the side walls, one of which is designated in FIG. 5 as apex portion 172*d*. Cam members 174, 176 are substantially identical in configuration to cam member 172, with the exception that cam member 174 has an hollowed annular interior portion which receives rotational force from drive member 180.

Figure 8:
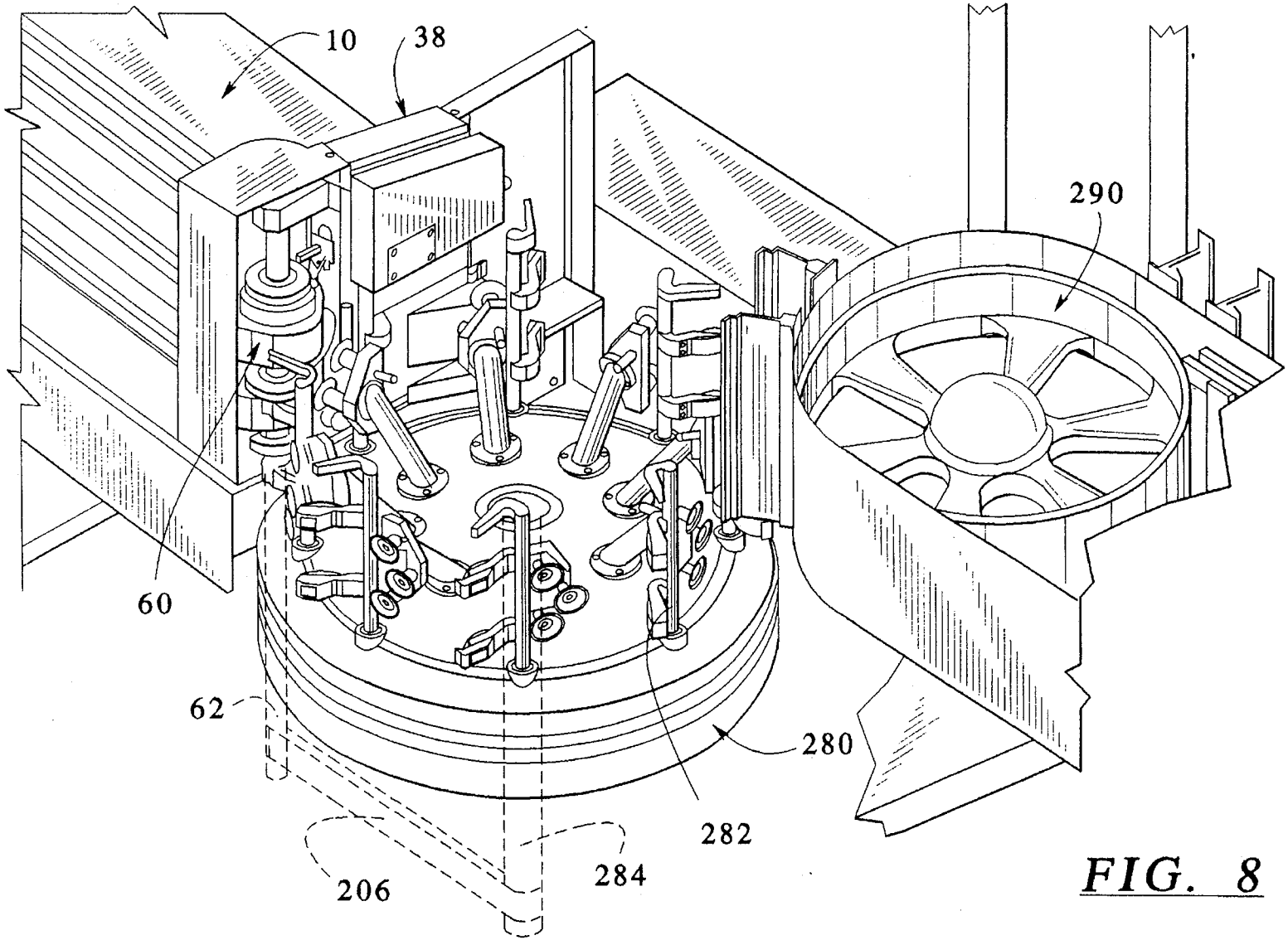
FIG. 8 is a perspective view of the portion of the packaging machine containing the carton blank magazine including the gate assembly, the bending cam mechanism, the rotary picker including the vacuum elements for displacing the carton blanks from the magazine, and the erected carton blank receiving conveyor.
Figure 9:
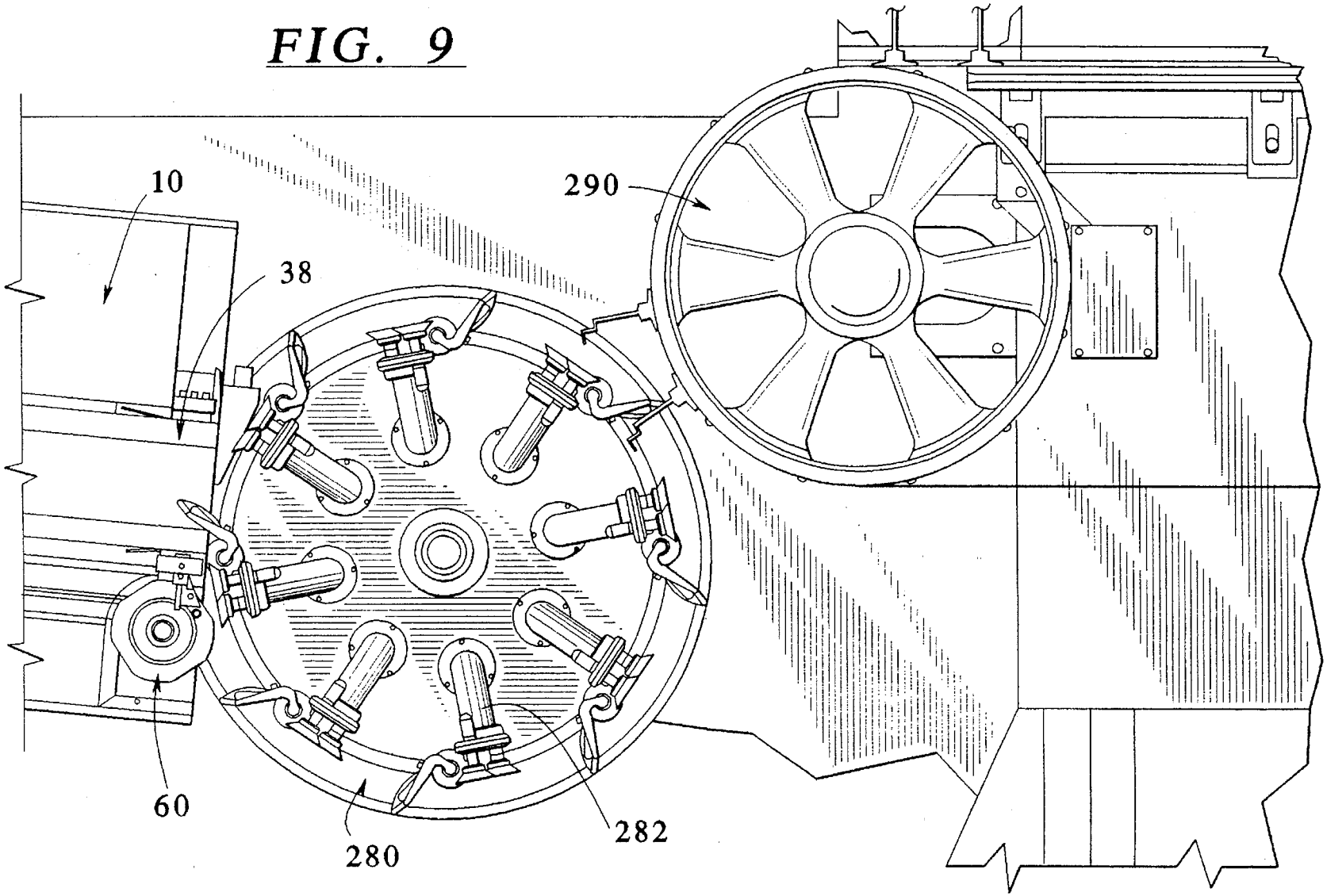
FIG. 9 is a top plan view of the portion of the packaging machine containing the carton blank magazine, bending cam mechanism, rotary picker, and erected carton blank receiving conveyor illustrated in FIG. 8.

FIGS. 8 and 9 show the portion of the packaging machine containing the carton blank magazine 10 including gate assembly 38, bending cam mechanism 60, rotary picker 280 including vacuum elements 282 for displacing carton blanks (not shown in FIGS. 8 and 9) away from magazine 10, and erected carton blank receiving conveyor 290. As shown in FIG. 8, a band 286 interconnects shaft 62, which extends from breaking cam mechanism 60, and shaft 284, which extends from rotary picker 280. Band 286 synchronizes the rotation of shaft 62 with that of rotary picker 280.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. An apparatus for bending carton blanks fed from the magazine of a packaging machine, each of the carton blanks having a gripped portion held by the packaging machine and a bendable portion extending from the gripped portion, the apparatus comprising:

(a) a rotatable shaft mounted on said packaging machine, said shaft having a longitudinal axis;

(b) at least one cam member mounted on said shaft, said at least one cam member having a plurality of longitudinally extending side walls and apex portions interconnecting said side walls; and (c) means for rotating said shaft about its longitudinal axis such that said side walls are adjacent the gripped portions of the carton blanks and said apex portions radially displace the bendable portions of the carton blanks as the carton blanks are fed from the magazine.

2. The apparatus of claim 1 wherein said at least one cam member comprises a plurality of longitudinally spaced cam members.

3. The apparatus of claim 1 wherein said at least one cam member has four longitudinally extending side walls and four apex portions interconnecting said side walls.

4. The apparatus of claim 1 wherein said shaft is rotatably mounted on said magazine.

5. A method for bending carton blanks fed from the magazine of a packaging machine, each of the carton blanks having a gripped portion held by the packaging machine and a bendable portion extending from the gripped portion, the method comprising:

(a) mounting a rotatable shaft on said packaging machine, said shaft having a longitudinal axis;

(b) mounting at least one cam member on said shaft, said at least one cam member having a plurality of longitudinally extending side walls and apex portions interconnecting said side walls; and (c) rotating said shaft about its longitudinal axis such that said side walls are adjacent the gripped portions of the carton blanks and said apex portions radially displace the bendable portions of the carton blanks as the carton blanks are fed from the magazine.

* * * * *

UNITED STATES PATENT AND TRADEMARK OFFICE

CERTIFICATE OF CORRECTION

PATENT NO. : 5,469,690
DATED : November 28, 1995
INVENTOR(S) : Joakim Nordell

It is certified that error appears in the above-indentified patent and that said Letters Patent is hereby corrected as shown below:

ON THE COVER SHEET

Please change the name of Neld to Held and include the name of Patrick N. Burkhart in the "Attorney, Agent or Firm".

Signed and Sealed this

Third Day of September, 1996

*Attest:*

Bruce Lehman

BRUCE LEHMAN

*Attesting Officer*

*Commissioner of Patents and Trademarks*